US007004443B2

(12) United States Patent
Bennett

(10) Patent No.: US 7,004,443 B2
(45) Date of Patent: Feb. 28, 2006

(54) CONCRETE VOID FORMER

(75) Inventor: Clifford D. Bennett, Alta Loma, CA (US)

(73) Assignee: Dayton Superior Corporation, Dayton, OH (US)

( * ) Notice: Subject to any disclaimer, the term of this patent is extended or adjusted under 35 U.S.C. 154(b) by 28 days.

(21) Appl. No.: 10/392,070

(22) Filed: Mar. 19, 2003

(65) Prior Publication Data

US 2004/0182987 A1 Sep. 23, 2004

(51) Int. Cl.
*B28B 7/28* (2006.01)
*B28B 7/16* (2006.01)

(52) U.S. Cl. ..... 249/185; 249/177; 249/186

(58) Field of Classification Search ..... 249/177, 249/180, 184, 185, 186
See application file for complete search history.

(56) References Cited

U.S. PATENT DOCUMENTS

| | | | | | |
|---|---|---|---|---|---|
| 376,019 | A | * | 1/1888 | Wilder | 249/186 |
| 795,518 | A | * | 7/1905 | Lamp | 249/180 |
| 895,255 | A | * | 8/1908 | Goddard | 249/184 |
| 955,235 | A | | 4/1910 | Wellman | |
| 1,641,147 | A | * | 9/1927 | Barton | 249/186 |
| 2,063,552 | A | | 12/1936 | Mensch | |
| 2,096,702 | A | | 10/1937 | Yeoman | |
| 2,386,582 | A | * | 10/1945 | Woodward | 249/177 |
| 2,494,869 | A | | 1/1950 | Godwin | |
| 2,818,618 | A | * | 1/1958 | Winship et al. | 249/186 |
| 3,677,688 | A | * | 7/1972 | Morgan | 249/184 |
| 3,856,256 | A | * | 12/1974 | Celesti | 249/184 |
| 3,889,916 | A | * | 6/1975 | Ilukowicz | 249/177 |
| 4,089,502 | A | * | 5/1978 | Miller | 249/177 |
| 4,296,909 | A | * | 10/1981 | Haeussler | 249/185 |
| 4,383,675 | A | * | 5/1983 | Fricker | 249/177 |
| 4,515,271 | A | | 5/1985 | Auciello et al. | |
| 4,821,994 | A | * | 4/1989 | Fricker | 249/185 |
| 5,005,331 | A | | 4/1991 | Shaw et al. | |
| 5,040,350 | A | | 8/1991 | Panther | |
| 5,216,862 | A | | 6/1993 | Shaw et al. | |
| 5,487,249 | A | * | 1/1996 | Shaw et al. | 404/60 |
| 5,651,911 | A | * | 7/1997 | Pennypacker | 249/177 |
| 5,674,028 | A | | 10/1997 | Norin | |
| 5,695,790 | A | * | 12/1997 | Lin | 249/186 |
| 5,934,821 | A | | 8/1999 | Shaw et al. | |
| 6,354,760 | B1 | * | 3/2002 | Boxall et al. | 404/56 |
| 6,575,424 | B1 | * | 6/2003 | Domizio | 249/177 |

* cited by examiner

*Primary Examiner*—Michael Safavi
(74) *Attorney, Agent, or Firm*—Wood,Herron & Evans

(57) ABSTRACT

A void former comprises a core assembly having at least two body members. The body members are removably coupled together to define the desired shape of a void to be formed in a concrete slab. After the void has been formed in the concrete slab, the body members may be selectively removed from the void.

1 Claim, 4 Drawing Sheets

CONCRETE VOID FORMER

FIELD OF THE INVENTION

The present invention pertains to the construction of concrete slabs, and more particularly to a device for creating a flat void in a concrete slab.

BACKGROUND OF THE INVENTION

In the construction of flat concrete surfaces, such as aircraft runways, taxiways, parking aprons, and other concrete structures it is common to divide the surface into a number of individual slabs that are separated by expansion joints. Adjacent slabs are typically coupled to one another by dowels that extend across the expansion joints. The dowels help to transfer loads between adjacent slabs and to control relative movement of the slabs. Conventional concrete dowels have been provided as elongate metal rods or flat metal plates. Regardless of whether rods or plates are used as dowels, a void must be formed in each concrete slab to receive a portion of the dowel. Such voids are typically formed in wet concrete, either at the time of pour, by attaching void formers to the inner surface of concrete edge forms, or after the edge forms have been removed, by inserting void formers into the still wet concrete.

A drawback of previous methods and apparatus for forming voids in slabs is that it is very difficult to remove the void formers from the concrete after the concrete has cured. This is due primarily to the surface adhesion between the concrete and the void former and is particularly problematic for void formers used to create flat-shaped slots in concrete slabs for receiving load plates. Even when void formers are made from plastic, which does not bond to the concrete, surface adhesion between the concrete and the void former makes it difficult to pull the void former from the concrete.

There is thus a need for a void former for creating flat-shaped voids in concrete slabs which overcomes drawbacks of the prior art, such as those described above.

SUMMARY OF THE INVENTION

The present invention provides a void former for creating flat-shaped voids in concrete slabs. The void former comprises a core assembly having at least two body members that are removably coupled together to define the desired void shape. The body members contact one another along confronting tapered surfaces, whereby separation of individual body members from the core assembly may be accomplished by sliding movement along the tapered surfaces. Advantageously, the body members may be successively removed from the void, once the concrete slab has sufficiently cured, to make removal of the void former easier.

In one exemplary embodiment, the void former includes two body members, each having a shape generally in the form of a truncated triangular prism. In this embodiment, the body members may be coupled along their respective tapered surfaces to form a triangular prism shape.

According to another aspect of the invention, the body members may be connected together by a frangible attachment that helps to maintain the body members in proper position during use. When it is desired to remove the void former from the void, the frangible attachments may be broken to permit selective removal of the body members. In one exemplary embodiment, the body members are attached by hinge members. In another exemplary embodiment, the body members are attached by a slidable joint.

In yet another aspect of the invention, a method of forming a void in a concrete slab includes creating a form to receive poured concrete, pouring concrete into the form to make the slab, and forming a void in the slab using a void former having at least two body members that are removably coupled together to define the void shape and configured to be selectively separated to facilitate removal of the void former from the void. In one embodiment, the void former may be attached to an edge form prior to pouring the concrete. Alternatively, the void former may be inserted into the concrete slab after the slab has sufficiently cured to permit removal of the forms.

In another aspect of the invention, a method of forming a concrete construction having a plurality of adjacent concrete slabs includes creating a form for receiving poured concrete, pouring concrete into the form to form a first slab, forming at least one void in the slab with a void former of the present invention, removing the void former, inserting a load plate into the void, and forming a second slab adjacent the first slab.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
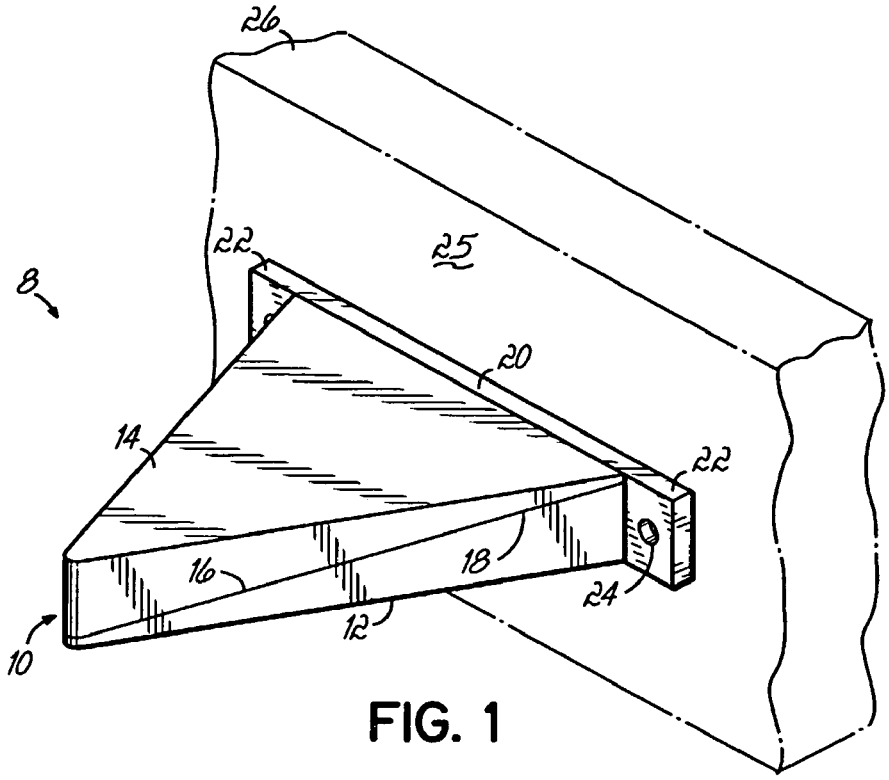
FIG. 1 is perspective view of an exemplary concrete void former, according to the present invention.

Referring to FIG. 1, there is shown an exemplary void former 8 of the present invention. The void former 8 comprises a core assembly 10 having first and second core body members 12, 14 removably coupled together to define a shape that will form a void in a concrete slab. In the exemplary embodiment shown, the core assembly 10 has the general shape of a triangular prism, wherein the first and second body members 12, 14 comprise adjacent truncated triangular prisms that engage one another along respective tapered surfaces 16, 18 to create the triangular prism shape. It will be recognized, however, that core assembly 10 may have other shapes suitable for forming a generally flat slot in a concrete slab. In the exemplary embodiment shown, the core assembly 10 further includes an attachment member 20 coupled to first body member 12. The attachment member 20 has first and second flanges 22 disposed proximate opposed ends of the attachment member 20, each flange 22 having apertures 24 for receiving a fastener, whereby the core assembly 10 may be secured to one side 25 of a concrete edge form 26 (shown in phantom in FIG. 1).

In the exemplary embodiment shown, the core assembly 10 may be formed from plastic material and the first and second body members 12, 14 removably coupled together, whereby the first and second body members 12, 14 may be selectively separated to facilitate removal of the core assembly 10 from a void formed in a slab of concrete.

Figure 2A:
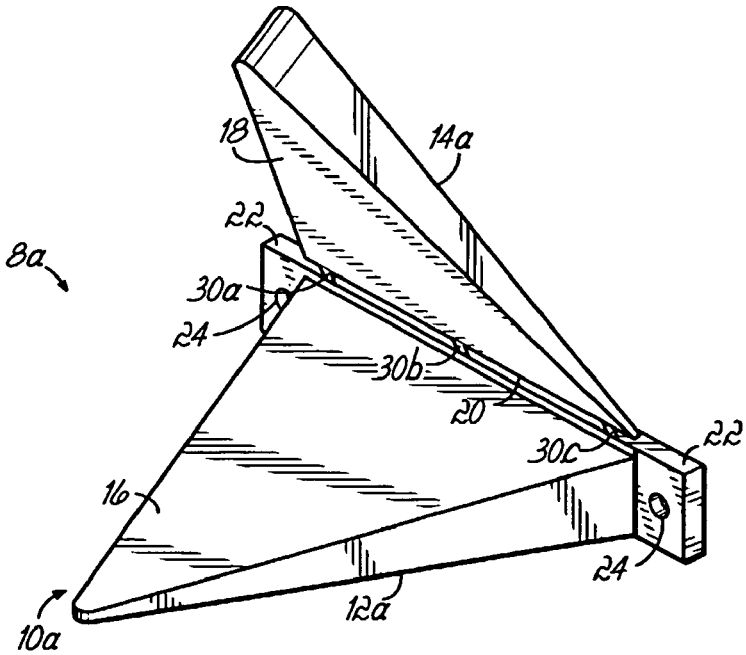
FIGS. 2A–2B are perspective views of exemplary embodiments of the void former of FIG. 1, wherein body members are hingedly coupled.
Figure 2B:
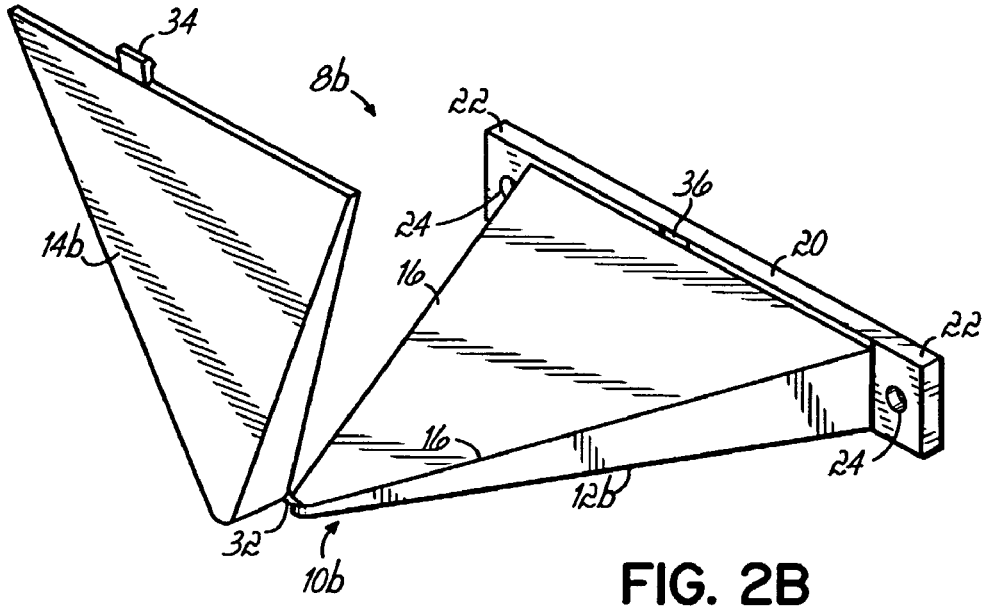

Referring now to FIGS. 2A–2B, there are shown exemplary embodiments wherein the first and second body members 12, 14 are coupled together by one or more hinge members. In the figures, like components have been correspondingly numbered. In FIG. 2A, the exemplary void former 8*a* has hinge members 30*a*, 30*b*, 30*c* disposed between the first and second body members 12*a*, 14*a* proximate a side of the triangular prism shape of the core assembly 10*a*. In FIG. 2B, another exemplary void former 8*b* has a hinge member 32 disposed between the first and second body members 12*b*, 14*b* at the corner of the triangular prism shape, opposite the attachment member 20. In this embodiment, second body member 14*b* may also include a tab 34 disposed along the side edge opposite hinge member 32, and attachment member 20 includes a slot 36 formed adjacent the first body member 12*b*. The tab 34 is engageable with slot 36 when the first and second body members 12*b*, 14*b* are positioned to place tapered surfaces 16, 18 in confronting contact with one another to thereby hold body members 12*b*, 14*b* in position. In another embodiment, the hinges 30*a*–30*c* and 32 are frangible, whereby the first and second body members 12, 14 may be separated, for example, when it is desired to remove the body members 12, 14 from a concrete slab.

Figure 3:
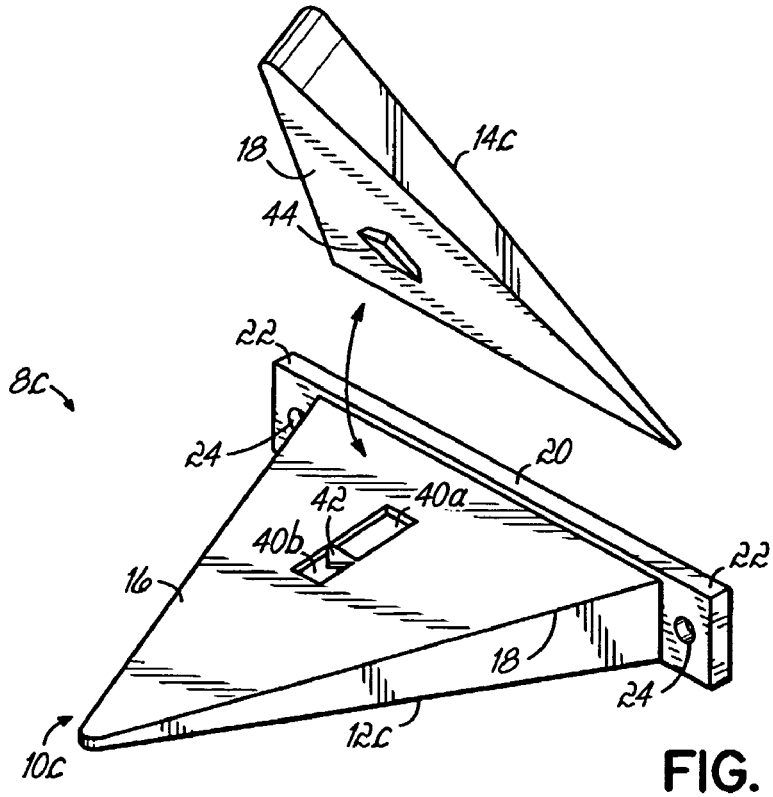
FIG. 3 is a perspective view of an exemplary embodiment of the void former of FIG. 1, wherein body members are coupled by a slidable dovetail joint.

Another exemplary embodiment of a void former 8*c* according to the present invention will now be described with reference to FIG. 3. The core assembly 10*c* of void former 8*c* comprises first and second body members 12*c*, 14*c*, which may be removably coupled together along confronting surfaces 16, 18 by a sliding dovetail joint. In the exemplary embodiment shown, slots 40*a*, 40*b* are formed into tapered surface 16 on first body member 12*c*. The slots 40*a*, 40*b* are separated by a frangible rib 42. A dovetail-shaped protrusion 44 is formed on tapered surface 18 of second body member 14*c*, and is configured to slidably engage slots 40*a*, 40*b* when core assembly 10*c* is assembled by placing respective tapered surfaces 16, 18 in confronting engagement.

Upon initial assembly, dovetail protrusion 44 engages slot 40*a* and abuts rib 42 such that the first and second body members 12*c*, 14*c* are in proper registration to form the triangular prism shape of the void former 8*c*. Advantageously, frangible rib 42 may be broken by the exertion of a sufficient shear force applied to the respective body members 12*c*, 14*c* to cause the body members to slide relative to one another along confronting surfaces 16, 18. After rib 42 has been broken, dovetail protrusion 44 remains engaged in slot 40*a* and may be slidingly moved from slot 40*a* to slot 40*b* as the first and second body members 12*c*, 14*c* are slidingly moved relative to one another along confronting surfaces 16, 18. When dovetail protrusion 44 contacts the distal end of slot 40*b*, no further relative movement will occur between the body members 12*c*, 14*c*. This limited sliding movement permitted by the interaction of dovetail protrusion 44 with slots 40*a*, 40*b* allows the first body member 12*c* to be partially withdrawn from a sufficiently cured concrete slab, wherein the sliding movement along the interface of tapered surfaces 16, 18 facilitates removal of the first body member 12*c*. Advantageously, when dovetail protrusion 44 contacts the distal end of slot 40*b*, further movement of the first body member 12*c* causes the second body member 14*c* to be pulled with the first body member 12*c*, thereby facilitating removal of the second body member 14*c*. Furthermore, the increased space afforded by the partial removal of first body member 12*c* makes it easier to remove the second body member 14*c*.

Figure 4A:
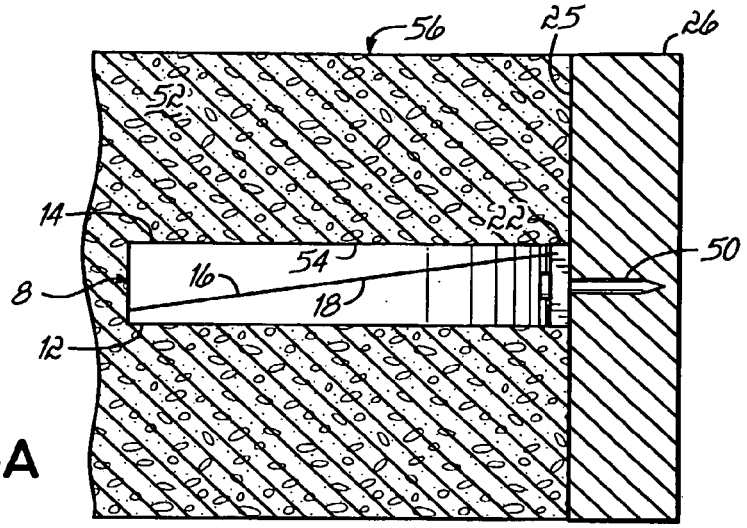
FIGS. 4A–4E are cross-sectional views illustrating use of the void former of FIG. 1 in the construction of a doweled joint.
Figure 4B:
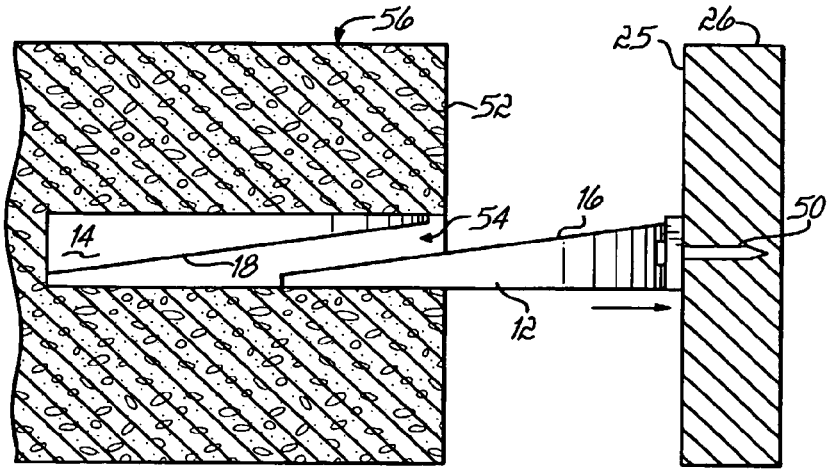
Figure 4C:
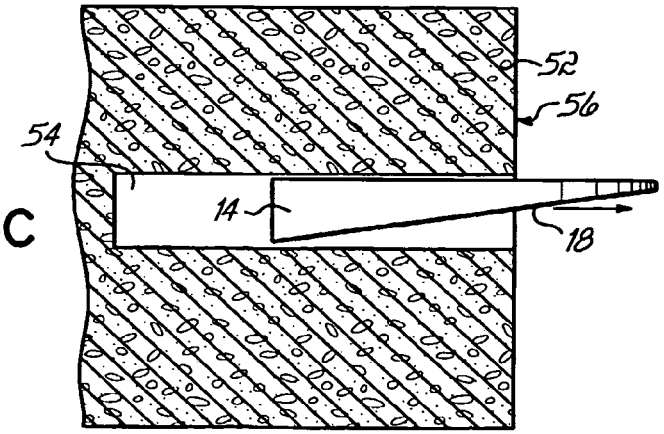

Referring now to FIGS. 4A–4E, use of the void former 8 to create a doweled concrete joint will now be described. FIG. 4A is a partial cross-sectional view depicting a void former 8 secured to one side 25 of a concrete edge form 26 by fasteners 50 installed through the apertures 24 in the flanges 22. Edge form 26 may be used in conjunction with other form members (not shown) to define a space for receiving poured, wet concrete 52 to thereby create a concrete slab 56. As wet concrete 52 is poured into the form, void former 8 forms a flat shaped void 54 in the concrete slab 56. After the concrete 52 has sufficiently cured, the concrete edge form 26 may be removed, as depicted in FIG. 4B. Advantageously, removal of the edge form 26 separates the first body member 12 from the core assembly 10 and withdraws the first body member 12 from the void 54 that has been formed in the slab 56. Advantageously, the first body member 12 is easily removed from the void 54 because the confronting tapered surfaces 16, 18 of the respective body members 12, 14 facilitate sliding of the first body member 12 along the sloped interface. After the first body member 12 has been removed from the void 54, the second body member 14 may be grasped and easily removed from the void 54 due to the increased clearance within the void 54 caused by the removal of the first body member 12. Removal of the second body member 14 from void 54 is depicted in FIG. 4*c*. Alternatively, it will be recognized that the first and second body members 12, 14 may be tethered together for automatic removal of both members 12, 14 as the edge form 26 is removed from the concrete slab 56 whereby the first and second body members 12, 14 are successively removed from the void 54.

Figure 4D:
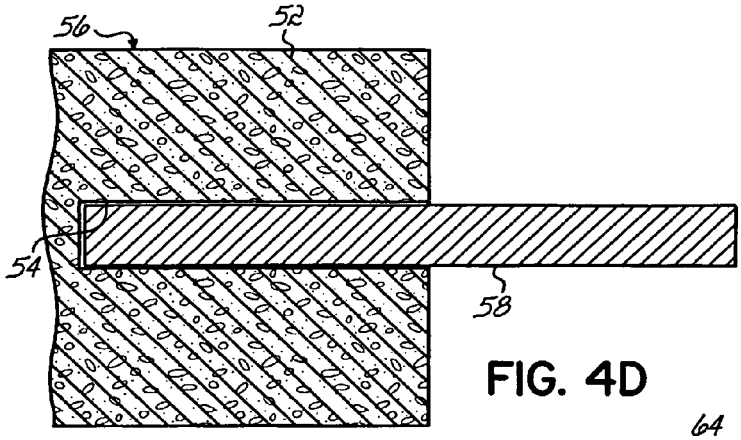

After the first and second body members 12, 14 have been removed from void 54, a dowel in the form of a flat plate 58 may be inserted into the void 54, as depicted in FIG. 4D. Dowel plate 58 is configured so that a portion of the dowel plate 58 protrudes from void 54. To complete the concrete construction 64, a second concrete slab 60 is formed adjacent slab 56, separated by an expansion joint 62, by pouring wet concrete 52 into a form which has been prepared adjacent slab 56. As the wet concrete 52 is poured to create the second slab 60, the concrete surrounds that portion of the dowel plate 58 protruding from void 54 in slab 56.

Figure 4E:
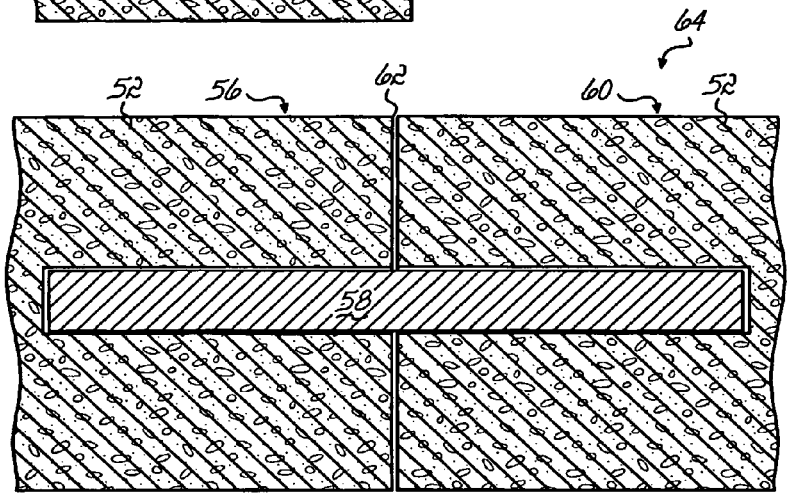
Figure 5:
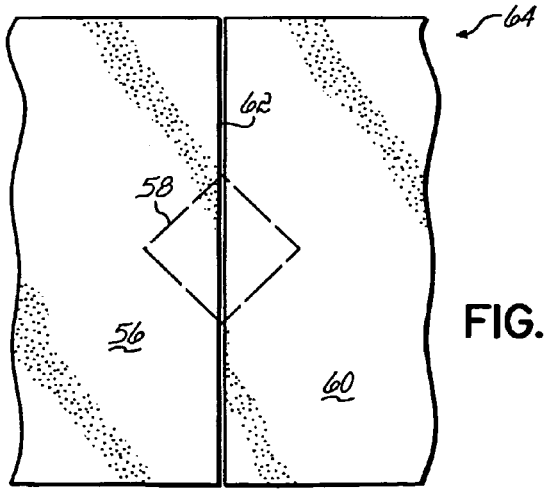
FIG. 5 is a plan view of adjacent concrete slabs with a load plate installed in corresponding voids created by the void former of the present invention.

Referring now to FIG. 5, there is shown a plan view of the exemplary concrete construction 64 of FIG. 4E comprising adjacent concrete slabs 56, 60 coupled together by a load plate 58 disposed across an expansion joint 62 between the slabs 56, 60. Advantageously, the load plate 58 may be bonded to the second concrete slab 60 whereby relative motion between the concrete slabs 56, 60 in a plane parallel to the surface of the slabs 56, 60 is permitted by movement of the load plate 58 within the void 54 created by the void former 8 of the present invention.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A void former for forming a void in a concrete slab having an edge defined by a concrete edge form, the void former comprising:

a core assembly including at least two body members removably joined together by an interconnection extending therebetween, said body members having complementary shapes which together define the shape of the void, said body members configured to be selectively separated from said core assembly to thereby facilitate removal of the void former from the void formed in the concrete slab;

said core assembly including at least two substantially parallel concrete engaging outer walls spaced apart to form corresponding parallel surfaces of the void formed in the concrete slab, wherein said body members are hingedly joined together.

* * * * *